United States Patent [19]

Savas et al.

[11] 4,206,333

[45] Jun. 3, 1980

[54] DOUBLE POLE SLIDING CONTACT TRIGGER SWITCH WITH SEQUENTIAL AUXILIARY BUTT CONTACTS

[75] Inventors: Charles R. Savas, Huntsville; Jackson H. Smith, Union Grove, both of Ala.

[73] Assignee: Eaton Corporation, Cleveland, Ohio

[21] Appl. No.: 934,420

[22] Filed: Aug. 17, 1978

[51] Int. Cl.[2] ..... H01H 13/64; H01H 15/08

[52] U.S. Cl. ..... 200/5 R; 200/1 B; 200/16 C; 200/260; 200/290

[58] Field of Search ..... 200/157, 159 R, 260, 200/290, 1 B, 1 V, 16 C, 340, 5 R

[56] References Cited

U.S. PATENT DOCUMENTS

| | | | |
|---|---|---|---|
| 2,488,670 | 11/1949 | Koenig | 200/16 C |
| 3,092,699 | 6/1962 | Latour | 335/195 |

*Primary Examiner*—Frederick R. Schmidt

*Attorney, Agent, or Firm*—Hugh R. Rather; William A. Autio

[57] ABSTRACT

A double pole sliding contact trigger switch is disclosed having auxiliary butt contact means for affording sequential actuation of a pair of switches in a single housing. Upon depression of the trigger, a double pole switch is closed by sliding bridging contactors to energize a portable tool motor. Upon further depression of the trigger, a single pole switch is closed by a butting bridging contactor to energize a solenoid in the tool.

9 Claims, 4 Drawing Figures

Fig. 1
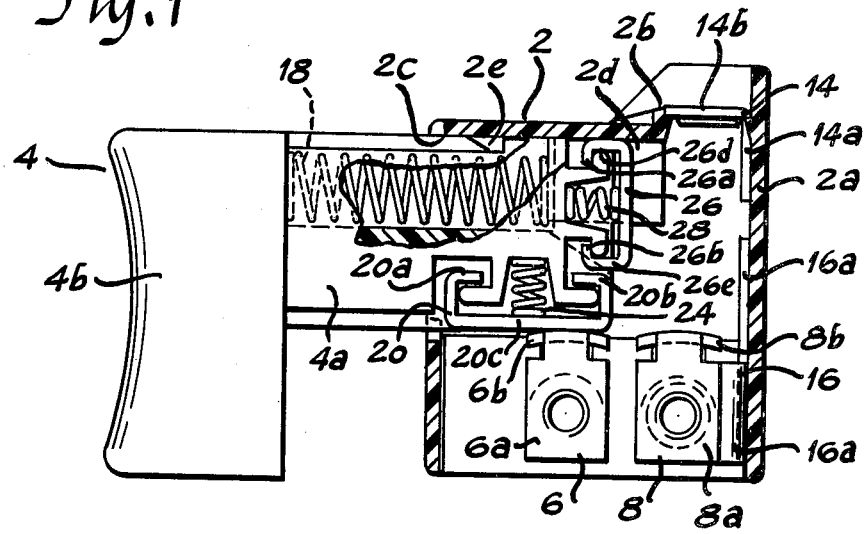
Fig. 2
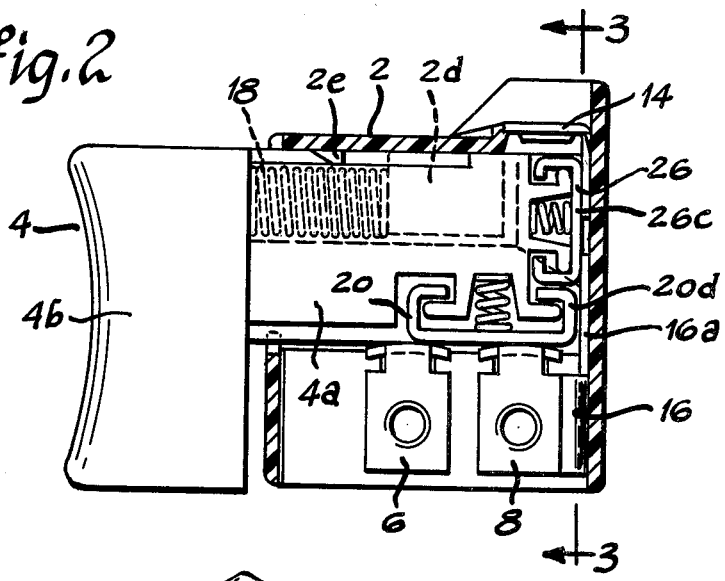
Fig. 3
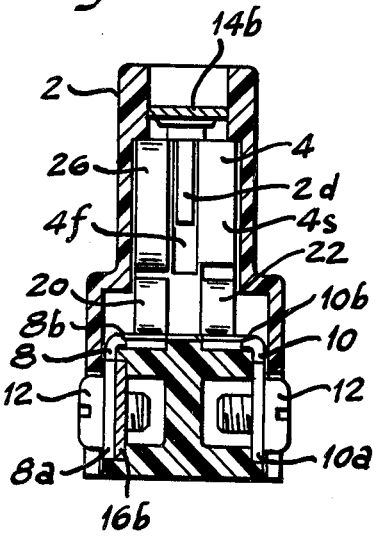
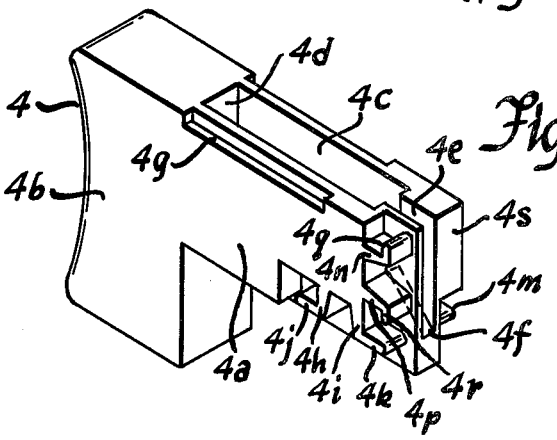
Fig. 4

DOUBLE POLE SLIDING CONTACT TRIGGER SWITCH WITH SEQUENTIAL AUXILIARY BUTT CONTACTS

BACKGROUND OF THE INVENTION

The present invention relates to improvements in the trigger and related switch arts. The invention specifically arose from efforts to provide a low cost trigger switch for a hand held portable tool and having two sets of contacts which are sequentially actuated upon finger depression of the trigger to sequentially energize a pair of circuits in the tool, though the invention is of course not limited thereto.

SUMMARY OF THE INVENTION

An object of the invention is to provide an improved switch affording sequential actuation of a set of sliding contacts and a set of butting contacts in the same housing.

Another object is to provide a compact trigger switch of the aforementioned character, particularly designed to enable one contact set to carry high load current, while the other contact set may have a lower current rating.

Another object is to provide a trigger switch of the aforementioned character comprising main stationary contacts engaged by bridging contactor means in sliding and wiping relation upon depression of the trigger to close a main circuit, and comprising auxiliary stationary contacts engaged by bridging contactor means in butting relation upon further depression of the trigger to close an auxiliary circuit, and upon release of the trigger the auxiliary circuit opens before the main circuit opens.

Another object is to provide a trigger switch of the aforementioned character having mounting means for the auxiliary butting contactor which enable a certain amount of free play at the end of the trigger travel stroke whereby the trigger need not be held absolutely fully depressed in order to maintain closure of the auxiliary circuit, and also having positive disengagement means effective during trigger release at the free play limit to strike the auxiliary butting contactor and positively pull it away from the auxiliary contacts and thus assure opening of the auxiliary circuit.

Another object is to provide a trigger switch of the aforementioned character particularly designed for double pole main contacts aligned in a common plane parallel to the direction of trigger travel and perpendicular to a plane containing the auxiliary contacts, the sliding bridging contactor means comprising a pair of main contactors carried by the trigger and biased perpendicularly from the latter's line of travel into engagement with the main contacts, the butting bridging contactor means comprising an auxiliary contactor carried by the trigger rearwardly of the main contactors and biased rearwardly in the line of travel of the trigger to engage the auxiliary contacts upon further rearward depression of the trigger.

Another object is to provide a trigger switch of the aforementioned character having a novel housing enabling mounting of both the double pole main contacts and the auxiliary contacts in the requisite specified orientation, and particular cooperation of some of these contacts.

Another object is to provide a trigger switch of the aforementioned character with a novel trigger operator having particular mounting means integrally formed thereon for mounting the main and auxiliary contactors in the requisite orientation to cooperate with the main and auxiliary contacts mounted in the housing and specifically affording sequential actuation.

Another object is to provide a trigger switch of the aforementioned character wherein each contactor comprises an elongated squared-C-shaped member having inwardly tucked tips and each mounting means therefor comprises a pair of separated standing ear portions extending from the main body of the trigger and having oppositely outwardly extending turned ends tucked interiorly of and behind the tips of the C-shaped contactor to retain the latter, and a bias spring extending between the spaced mounting ears and bearing between the main body of the trigger and the main body of the C-shaped contactor.

Other objects and advantages will hereinafter appear.

BRIEF DESCRIPTION OF THE DRAWINGS

FIG. 1 is a side elevation view of a switch constructed in accordance with the invention, with the side housing wall removed.

FIG. 2 is like FIG. 1, but shows the switch in an actuated condition.

FIG. 3 is a sectional view taken along line 3—3 of FIG. 2.

FIG. 4 is an isometric view of the trigger.

DESCRIPTION OF THE PREFERRED EMBODIMENT

There is shown in FIG. 1 a housing 2 guiding a trigger operator 4 which may be rearwardly slid to an actuated condition, FIG. 2.

The housing had double pole stationary contact terminals mounted therein comprising a left set 6 and 8, and a right set, one of which 10 is shown in FIG. 3. As viewed in FIG. 1, the right set is disposed behind left set 6 and 8. Each contact terminal is inverted-L-shaped, having a vertical portion, e.g. *6a, 8a, 10a*, for external circuit connection by screws such as 12, FIG. 3. The other leg of the L is a slightly curved horizontal portion, such as *6b, 8b, 10b*. The horizontal legs of the contact terminals lie in a common horizontal plane and are engageable by a pair of sliding bridging contactors, to be described hereinafter. These double pole stationary contact terminals are connectable to a high current rated main circuit, such as a motor in a hand held tool in which the switch is mounted. Left set 6 and 8 comprise one pole, and the right set 10 and its mate the other pole, of a double pole main circuit.

Also mounted in the housing is a set of single pole auxiliary stationary contact terminals 14 and 16 for connection to an auxiliary circuit, such as a solenoid in the tool for engaging a member to be driven by the motor. Auxiliary contact terminal 14 is inverted-L-shaped having a vertical leg *14a* disposed against rear housing wall *2a*, FIG. 1, and a horizontal leg *14b* disposed on a horizontal section of top housing wall *2b* for external circuit connection, FIGS. 1 and 3. Terminal 16 has a vertical portion *16a* disposed against rear housing wall *2a* and spaced below terminal portion *14a* in a common vertical plane therewith extending perpendicularly out of the page, FIG. 1. Terminal 16 also has a lower vertical portion *16b* bent forwardly (leftwardly in FIG. 1) 90° from portion *16a* to lie flat against the inner edge of main terminal portion *8a*, FIG. 3, and share the common external circuit connection thereof. Terminal portions 14*a* and 16*a* are engageable by a butting bridging contactor, to be described hereinafter, to close a single pole auxiliary circuit.

Trigger operator 4, FIG. 4, is slidably mounted in housing 2 for rearward-forward (rightward-leftward, respectively, as viewed in FIG. 1) rectilinear reciprocal movement. The housing has an upper guiding channel through front opening 2*c*, FIG. 1, through which the rear inner section 4*a*, FIGS. 1 and 4, of the trigger reciprocates. The trigger has a front outer section 4*b* engageable by the finger of the user. A central longitudinal cavity 4*c*, FIG. 4, extends down into the trigger from above and receives helical compression spring 18 which bears between front cavity wall 4*d* and a front edge of a central dividing wall 2*d* of the housing, FIG. 1, to bias trigger 4 outwardly of the housing to the position shown in FIG. 1. Dividing wall 2*d* is a stationary rigid member integrally formed with the top housing wall and extending downwardly into the guiding channel in the upper section of the housing, FIG. 3. The trigger has a slot 4*e* cut through its rear end to communicate with cavity 4*c* and to permit clearance therethrough to central wall 2*d*. The bottom wall 4*f* of slot 4*e* is sloped rearwardly downwardly to facilitate ease of assembly.

When the trigger is in a released position, FIG. 1, wall 2*d* is in slot 4*e*, with the front edge of wall 2*d* extending slightly into cavity 4*c* to provide a stop against the rear end of bias spring 18. In the depressed position of the trigger, FIG. 2, wall 2*d* is disposed in cavity 4*c* as the bias spring has been compressed between front cavity wall 4*d* and the front edge of wall 2*d*. Formed on left and right sides of the top of the trigger are grooves, such as 4*g*, FIG. 4, whose back edge engages a nib 2*e* protruding down from the top housing wall to stop the forwardly biased movement of the trigger, FIG. 1.

Mounted on the bottom of the trigger are a pair of left and right main contactors 20 and 22, FIGS. 1 and 3, engageable in sliding bridging relation with the left set, 6 and 8, and right set, 10 and its mate, of the double pole main circuit stationary contact terminals, respectively. Each of these main contactors is a squared-C-shaped member identically mounted to the trigger.

The left underside of the trigger inner section 4*a*, FIG. 4, has a pair of spaced downwardly extending ear portions 4*h* and 4*i* having oppositely outwardly turned ends 4*j* and 4*k* protruding beneath inwardly tucked ends 20*a* and 20*b*, FIG. 1, of main contactor 20. Helical compression spring 24 is disposed between ear portions 4*h* and 4*i*, and bears against the bottom of the trigger body and contactor 20 at the center of the latter's elongated side 20*c*. Engagement of ends 20*a* and 20*b* with ends 4*j* and 4*k*, respectively, limit the downwardly biased movement of contactor 20 and retain the latter on the trigger. Spring 24 provides contact pressure by affording downwardly biased bridging engagement by contactor 20 of main contact terminals 6 and 8, FIG. 2. Right main contactor 22, FIG. 3, is identically mounted and closes the right pole of the main circuit when the trigger is depressed. The rear outwardly turned mounting ear end 4m for contactor 22 is visible in FIG. 4.

Mounted on the rear end of the trigger is an auxiliary squared-C-shaped contactor 26, FIG. 1, engageable in butting bridging relation with the single pole auxiliary stationary contact terminals 14 and 16. The mounting means for auxiliary contactor 26 is comparable to that for main contactors 20 and 22. The rear end of the trigger has on its left side, FIG. 4, a pair of spaced rearwardly extending ear portions 4*n* and 4*p* having oppositely outwardly upwardly and downwardly turned ends 4*q* and 4*r* protruding beneath inwardly tucked ends 26*a* and 26*b* of auxiliary contactor 26, FIG. 1. Helical compression spring 28 is disposed between ear portions 4*n* and 4*p*, and bears against the rear end of the trigger body and contactor 26 at the center of the latter's elongated side 26*c*. Engagement of ends 26*a* and 26*b* with ends 4*q* and 4*r*, respectively, limit the rearwardly biased movement of contactor 26 and retain the latter on the trigger.

FIG. 1 shows the switch in an off condition. Elongated side 20*c* of main contactor 20 is in engagement with main contact 6*b*, and main contactor 22 is in engagement with the main contact on the right side of the housing across (behind in FIG. 1) from contact 6*b*. Upon depression of the trigger, left side main contactor 20 slides along left side main contact 6*b* and into sliding bridging engagement with left side main contact 8*b*, FIG. 2, to close the left pole of the main circuit by completing a circuit from terminal 6 through left side bridging contactor 20 to terminal 8. The right side main contactor 22 simultaneously engages right side main contact 10*b*, FIG. 3, to close the right pole of the main circuit. Further depression of the trigger causes elongated side 26*c* of auxiliary contactor 26 to buttingly engage auxiliary contacts 14*a* and 16*a* to close the single pole auxiliary circuit by completing a circuit from terminal 14 through bridging contactor 26 to terminal 16.

The switch is provided with a certain amount of free play at the rear end of the trigger travel stroke so that the trigger need not be absolutely fully depressed in order to maintain closure of the auxiliary circuit. This is especially important in a trigger switch actuated by user applied finger pressure. The free play is enabled by the auxiliary contactor and its mounting means on the rear end of the trigger, particularly contactor sides 26*d* and 26*e* and ears 4*n* and 4*p*. The lineal length of free play is determined by the length of ears 4*n* and 4*p* in combination with the length of auxiliary contactor sides 26*d* and 26*e*. Even if the user does not keep the trigger firmly and fully depressed as in FIG. 2, bias spring 28 will compensate possible slack in user applied force and furnish the requisite contact pressure.

Upon trigger release, auxiliary contactor 26 remains in engagement with auxiliary contacts 14*a* and 16 *a* until a predetermined point in the return forward travel of the trigger, which is the limit of the free play. Turned ear ends 4*q* and 4*r* then strike inwardly turned ends 26*a* and 26*b* to positively pull auxiliary contactor 26 away from auxiliary contacts 14*a* and 16*a*, thus providing positive disengagement and assuring opening of the auxiliary circuit.

It is preferred that ears 4*n* and 4*p* to made long enough relative to contactor sides 26*d* and 26*e* so that at the end of the rearward trigger stroke, FIG. 2, the rear ends of ears 26*d* and 26*e* will strike elongated contactor side 26*c* before inwardly turned contactor ends 26*a* and 26*b* strike the trigger body.

Ears 4*n* and 4*p* and/or contactor sides 26*d* and 26*e* are made long enough so that elongated auxiliary contactor side 26*c*, FIG. 2, engages auxiliary contacts 14*a* and 16*a* before main contactor side 20*d* can strike auxiliary contact 16*a*. This insures that rearward trigger depression will not be halted prematurely, before closure of the auxiliary circuit. It is preferred that the rear ends of ears 26*d* and 26*e* strike elongated contactor side 26*c* before main contactor side 20*d* can reach auxiliary contact 16*a*, to provide positive direct closure of the auxiliary circuit upon full trigger depression without relying on the bias of spring 28.

In the embodiment shown, terminal 16 shares the same external circuit connection with terminal 8 because of the contiguous mounting, FIG. 3, of terminal portion 16*b*, terminal portion 8*a* and screw 12. The auxiliary circuit could also be completed between terminals 14 and 6 because in the on condition of the switch, FIG. 2, a circuit is completed from terminal 14 through bridging contactor 26 through terminal 16 through terminal 8 through contactor 20 to terminal 6. A modification would be to provide terminal 16 with its own independent external circuit connection.

In one particular application of the switch, the main circuit draws higher current relative to the auxiliary circuit. Thus the double pole main contacts are preferred, and the sliding wiping action is desirable, as well as the shearing of contact welds.

The lower rated auxiliary circuit only requires a single pole, and butt contacts are sufficient. There is of course room for a double pole auxiliary circuit by adding a contactor and mounting means therefor to the right rear end 4*s*, FIG. 4, of the trigger. It should be noted that the auxiliary ciruit could handle high current if desired because turned ends 4q and 4r provide positive contact break upon release of the trigger as they directly engage tucked ends 26*a* and 26*b* to pull contactor 26 away from terminal portions 14*a* and 16*a*.

It is recognized that various modifications are possible within the scope of the appended claims.

What is claimed is:

1. An electric switch providing sequential actuation of a main circuit and then an auxiliary circuit, comprising:

a housing;

main contact terminal means mounted in said housing and comprising spaced stationary main contacts;

auxiliary contact terminal means mounted in said housing and comprising spaced stationary auxiliary contacts;

operator means movably mounted to said housing;

main contactor means mounted to said operator means for sliding bridging engagement with said main contacts;

auxiliary contactor means mounted to said operator means for butting bridging engagement with said auxiliary contacts subsequent to said sliding bridging engagement of said main contactor and said main contacts during movement of said operator means; wherein said auxiliary contacts are spaced in a plane perpendicular to the line of travel of said operator means and said main contacts are spaced in a plane parallel to the line of travel of said operator means, and further comprising mounting means for said auxiliary contactor such that said auxiliary contactor engages said auxiliary contacts after said main contactor bridges said main contacts but slightly before said operator means reaches the end of its travel stroke whereby to enable a small amount of free play at the end of said operator means travel stroke while still maintaining bridging engagement of said auxiliary contactor and said auxiliary contacts.

2. The switch according to claim 1 wherein said mounting means comprises positive disengagement means effective upon return movement of said operator to strike said auxiliary contactor after a short amount of return travel from said end of said stroke and positively pull said auxiliary contactor away from said auxiliary contacts.

3. The switch according to claim 1 wherein said mounting means comprises biasing means bearing between said operator means and said auxiliary contactor to bias the latter in the direction of travel of said operator means towards said auxiliary contacts, and also comprises retaining means retaining said auxiliary contactor on said operator means against the bias of said biasing means, such that upon initial movement of said operator means said auxiliary contactor moves therewith until said auxiliary contactor buttingly engages said auxiliary contacts at a predetermined point in the travel stroke of said operator means, whereafter said auxiliary contactor remains stationary against said auxiliary contacts as said operator means completes the remainder of its travel to the end of its stroke compressing said biasing means, said retaining means comprising positive disengagement means effective upon return movement of said operator means at said predetermined point to strike said auxiliary contactor and positively pull said auxiliary contactor away from said auxiliary contacts, the distance between said predetermined point and said end of said travel stroke being the amount of free play enabled whereby said operator means need not be held absolutely firmly at the end of its travel stroke in order to maintain closure of said auxiliary circuit.

4. A trigger switch providing in a single housing sequential actuation of a main circuit and then an auxiliary circuit, comprising:

a housing;

a trigger movably mounted to said housing and having a finger engageable outer section and an inner section guided in said housing for linearly reciprocal rearward-forward motion;

trigger biasing means biasing said trigger forwardly;

means limiting the forward movement of said trigger;

main contact terminal means mounted to said housing and comprising a pair of stationary main contacts spaced in a plane parallel to trigger movement;

auxiliary contact terminal means mounted to said housing and comprising a pair of stationary auxiliary contacts spaced in a plane perpendicular to trigger movement and disposed on a rear wall of said housing;

main contactor means comprising a main contactor mounted to said trigger inner section and means biasing said main contactor away from said trigger inner section perpendicularly to trigger movement;

auxiliary contactor means comprising an auxiliary contactor mounted to the rear end of said trigger inner section and means biasing said auxiliary contactor rearwardly;

such that upon rearward movement of said trigger, said main contactor slidingly bridges said main contacts to close said main circuit, and upon further rearward movement of said trigger, said auxiliary contactor buttingly engages said auxiliary contacts to close said auxiliary circuit.

5. The trigger switch according to claim 4 providing an auxiliary circuit and a double pole main circuit all in a compact structure in a single housing, wherein:

said main contact terminal means comprises a left pair of main contacts horizontally spaced forwardly and rearwardly in said housing to form a left pole of said double pole main circuit, and also comprises a right pair of main contacts horizontally spaced forwardly and rearwardly in said housing to form a right pole of said double pole main circuit; and said main contactor means comprises left and right main contactors mounted to the left and right undersides of said trigger and biased downwardly to provide biased sliding bridging engagement of said left pair of main contacts by said left main contactor and of said right pair of main contacts by said right main contactor when said trigger is moved rearwardly.

6. The trigger switch according to claim 5 wherein said trigger has a cavity extending down thereinto in which is disposed a compression spring bearing at its front end against a front wall of said cavity and bearing at its rear end against the front edge of a stationary central dividing wall extending downwardly from a top housing wall into said cavity, said dividing wall also extending into a slot formed rearwardly from said cavity through said trigger inner section when said trigger is in a released forward position, said compression spring being compressed between said front cavity wall and said front edge of said central dividing wall upon rearward movement of said trigger, said auxiliary contactor being mounted to one side of said slot to allow clearance of said central dividing wall through said slot in the forward released position of said trigger, whereby to afford a compact switch structure and housing, and to enable said auxiliary contacts to be disposed on said rear wall of said housing.

7. The trigger switch according to claim 4 wherein:

said trigger inner section has main contactor retainer means mounting said main contactor to said trigger inner section against the bias of said main contactor biasing means, the latter bearing between said trigger inner section and said main contactor; and wherein said trigger inner section has auxiliary contactor retainer means on the rear end thereof mounting said auxiliary contactor to said trigger inner section rear end against the bias of said auxiliary contactor biasing means, the latter bearing between said trigger inner section rear end and said auxiliary contactor;

such that upon said rearward movement of said trigger said main contactor is carried therewith by said main contactor retainer means and slidingly bridges said main contacts in biased relation due to said main contactor biasing means; and such that upon said further rearward movement of said trigger said auxiliary contactor is carried therewith by said auxiliary contactor retainer means until said auxiliary contactor buttingly engages said auxiliary contacts in bridging relation at a predetermined point in the rearward travel stroke of said trigger, whereafter said auxiliary contactor remains stationary against said auxiliary contacts as said trigger completes the remainder of its rearward movement to the end of its rearward travel stroke compressing said auxiliary contactor biasing means;

said auxiliary contactor retainer means comprising positive disengagement means effective upon return forward movement of said trigger at said predetermined point to strike said auxiliary contactor and positively pull said auxiliary contactor away from said auxiliary contacts as said trigger continues its return forward movement, the lineal distance between said predetermined point and said rear end of said travel stroke in the linearly reciprocal movement of said trigger constituting a designated amount of free play at said rear end of said travel stroke whereby said trigger need not be held absolutely firmly at the end of its travel stroke in order to maintain closure of said auxiliary circuit.

8. The trigger switch according to claim 7 wherein:

said main contactor retainer means comprises a pair of spaced ears integrally formed on said trigger inner section and extending perpendicularly to the line of trigger movement, said ears having outwardly turned ends;

said main contactor comprises an elongated C-shaped member with inwardly tucked ends, the long side of the C engaging said main contacts;

said main contactor biasing means comprises a compression spring disposed between said ears and bearing at one end against said trigger inner section and at the other end against said elongated side of said C-shaped main contactor;

said outwardly turned ends of said ears extending interiorly of said C-shaped main contactor beneath the latter's inwardly tucked ends whereby to retain said main contactor on said trigger inner section against the bias of said compression spring;

and wherein:

said auxiliary contactor retainer means comprises a pair of spaced auxiliary ears integrally formed on the rear end of said trigger inner section and extending rearwardly therefrom, said auxiliary ears having outwardly turned ends;

said auxiliary contactor comprises an elongated C-shaped member with inwardly tucked ends, the long side of the C engaging said auxiliary contacts;

said auxiliary contactor biasing means comprises a compression spring disposed between said auxiliary ears and bearing at one end against said trigger inner section and at the other end against said elongated side of said C-shaped auxiliary contactor;

said outwardly turned ends of said auxiliary ears extending interiorly of said C-shaped auxiliary contactor beneath the latter's inwardly tucked ends whereby to retain said auxiliary contactor on the rear end of said trigger inner section against the bias of said last mentioned compression spring.

9. A trigger switch providing sequential actuation of a double pole main circuit and then an auxiliary circuit, all in a compact structure in a single housing, comprising:

a housing, a trigger movably mounted to said housing and having a finger engageable outer section and an inner section guided in said housing for linearly reciprocal rearward-forward motion;

trigger biasing means biasing said trigger forwardly;

means limiting the forward movement of said trigger;

main contact terminal means mounted to said housing and comprising a pair of stationary main contacts spaced in a plane parallel to trigger movement;

auxiliary contact terminal means mounted to said housing and comprising a pair of stationary auxiliary contacts spaced in a plane perpendicular to trigger movement and disposed on a rear wall of said housing;

main contactor means comprising a main contactor mounted to said trigger inner section and means biasing said main contactor away from said trigger inner section perpendicularly to trigger movement;

auxiliary contactor means mounted to the rear end of said trigger inner section and means biasing said auxiliary contactor rearwardly;

such that upon rearward movement of said trigger, said main contactor slidingly bridges said main contacts to close said main circuit, and upon further rearward movement of said trigger, said auxiliary contactor buttingly engages said auxiliary contacts to close said auxiliary circuits;

said trigger inner section having main contactor retainer means mounting said main contactor to said trigger inner section against the bias of said main contactor biasing means, the latter bearing between said trigger inner section and said main contactor;

said trigger inner section having auxiliary contactor retainer means on the rear end thereof mounting said auxiliary contactor to said trigger inner section rear end against the bias of said auxiliary contactor biasing means, the latter bearing between said trigger inner section rear end and said auxiliary contactor;

such that upon said rearward movement of said trigger said main contactor is carried therewith by said main contactor retainer means and slidingly bridges said main contacts in biased relation due to said main contactor biasing means; and such that upon said further rearward movement of said trigger said auxiliary contactor is carried therewith by said auxiliary contactor retainer means until said auxiliary contactor buttingly engages said auxiliary contacts in bridging relation at a predetermined point in the rearward travel stroke of said trigger, whereafter said auxiliary contactor remains stationary against said auxiliary contacts as said trigger completes the remainder of its rearward movement to the end of its rearward travel stroke compressing said auxiliary contactor biasing means;

said auxiliary contactor retainer means comprising positive disengagement means effective upon return forward movement of said trigger at said predetermined point to strike said auxiliary contactor and positively pull said auxiliary contactor away from said auxiliary contacts as said trigger continues its return forward movement; the lineal distance between said predetermined point and said rear end of said travel stroke in the linearly reciprocal movement of said trigger constituting a designated amount of free play at said rear end of said travel stroke whereby said trigger need not be held absolutely firmly at the end of its travel stroke in order to maintain closure of said auxiliary circuit;

said main contactor retainer means comprising a pair of spaced ears integrally formed on said trigger inner section and extending perpendicularly to the line of trigger movement, said ears having outwardly turned ends;

said main contactor comprising an elongated C-shaped member with inwardly tucked ends, the long side of the C engaging said main contacts;

said main contactor biasing means comprising a compression spring disposed between said ears and bearing at one end against said trigger inner section and at the other end against said elongated side of said C-shaped main contactor;

said outwardly turned ends of said ears extending interiorly of said C-shaped main contactor beneath the latter's inwardly tucked ends whereby to retain said main contactor on said trigger inner section against the bias of said compression spring;

said auxiliary contactor retainer means comprising a pair of spaced auxiliary ears integrally formed on the rear end of said trigger inner section and extending rearwardly therefrom, said auxiliary ears having outwardly turned ends;

said auxiliary contactor comprising an elongated C-shaped member with inwardly tucked ends, the long side of the C engaging said auxiliary contacts;

said auxiliary contactor biasing means comprising a compression spring disposed between said auxiliary ears and bearing at one end against said trigger inner section and at the other end against said elongated side of said C-shaped auxiliary contactor;

said outwardly turned ends of said auxiliary ears extending interiorly of said C-shaped auxiliary contactor beneath the latter's inwardly tucked ends whereby to retain said auxiliary contactor on the rear end of said trigger inner section against the bias of said last mentioned compression spring;

said main contact terminal means comprising a left pair of main contacts horizontally spaced forwardly and rearwardly in said housing to form a left pole of said double pole main circuit, and also comprising a right pair of main contacts horizontally spaced forwardly and rearwardly in said housing to form a right pole of said double pole main circuit;

said main contactor means comprising left and right main contactors mounted to the left and right undersides of the trigger inner section, each said left and right main contactor and its respective mounting means being as above defined;

said trigger having a cavity extending down thereinto;

said trigger biasing means comprising a compression spring disposed in said cavity and bearing at its front end against a front wall of said cavity and bearing at its rear end against the front edge of a stationary central dividing wall extending downwardly from a top housing wall into said cavity;

said trigger inner section having a slot formed therethrough rearwardly from said cavity, said dividing wall extending down into said slot when said trigger is in a released forward position stopped by said limiting means; and said auxiliary contactor being mounted to one side of said slot to allow clearance of said dividing wall through said slot in said forward released position of said trigger, whereby to afford a compact switch structure and housing.

* * * * *